US010624458B2

(12) United States Patent
Turowski et al.

(10) Patent No.: US 10,624,458 B2
(45) Date of Patent: Apr. 21, 2020

(54) HEIGHT-ADJUSTABLE FOOTREST

(71) Applicant: ASS-Einrichtungssysteme GmbH, Stockheim (DE)

(72) Inventors: Kai Turowski, Telgte (DE); Lutz Kühnau, Sonneberg (DE)

(73) Assignee: ASS-EINRICHTUNGSSYSTEME GMBH, Stockheim (DE)

( * ) Notice: Subject to any disclaimer, the term of this patent is extended or adjusted under 35 U.S.C. 154(b) by 81 days.

(21) Appl. No.: 15/891,861

(22) Filed: Feb. 8, 2018

(65) Prior Publication Data

US 2018/0228293 A1 Aug. 16, 2018

(30) Foreign Application Priority Data

Feb. 10, 2017 (DE) ..... 10 2017 102 725

(51) Int. Cl.
*A47C 7/50* (2006.01)

(52) U.S. Cl.
CPC ..... *A47C 7/5064* (2018.08); *A47C 7/506* (2013.01)

(58) Field of Classification Search
CPC ..... A47C 7/506; A47C 7/5064; A47C 7/52
See application file for complete search history.

(56) References Cited

U.S. PATENT DOCUMENTS 390,477 A 10/1888 Hogan
1,964,216 A * 6/1934 Sargent ..... A47C 7/506 297/423.38
2,546,871 A * 3/1951 Walker ..... A47C 7/506 297/423.38
4,582,359 A 4/1986 Wise et al.
(Continued)

FOREIGN PATENT DOCUMENTS

DE 3523273 A1 1/1986
GB 419159 11/1934
(Continued)

OTHER PUBLICATIONS

Extended European search report with the European search opinion issued for corresponding European Patent Application No. 18155160.7 dated Jun. 8, 2018.
(Continued)

*Primary Examiner* — David R Dunn
*Assistant Examiner* — Tania Abraham
(74) *Attorney, Agent, or Firm* — Myers Wolin, LLC

(57) ABSTRACT

A lock is provided for locking a footrest at two chair legs of a chair is provided. The lock has a first blocking rod, a second blocking rod, and an adjustment means cooperating with the two blocking rods. The adjustment means is supported rotatably about a rotation axis, the two blocking rods are arranged coaxially and spaced apart from each other and are respectively perpendicular with respect to the rotation axis (DA), the two blocking rods are respectively coupled to the adjustment means, and a rotation of the adjustment means about the rotation axis (DA) causes the two blocking rods to move synchronously in opposite directions. Also provided are a footrest having a lock according to this disclosure and a chair having one or both of a lock according to this disclosure and a footrest according to this disclosure.

15 Claims, 4 Drawing Sheets

(56) References Cited

U.S. PATENT DOCUMENTS

| | | | | | |
|---|---|---|---|---|---|
| 4,728,150 | A * | 3/1988 | Gaudreau, Jr. | ..... | A47C 1/023 297/284.1 |
| 4,767,160 | A * | 8/1988 | Mengshoel | ..... | A47C 7/52 297/423.12 |
| 9,089,219 | B2 * | 7/2015 | Lee | ..... | A47C 7/52 |
| 2009/0224591 | A1 | 9/2009 | Langhorn | | |
| 2015/0115685 | A1 | 4/2015 | Lee | | |

FOREIGN PATENT DOCUMENTS

| | | | | | |
|---|---|---|---|---|---|
| GB | 419159 | A | | 11/1934 | |
| JP | 09238775 | A | * | 9/1997 | ..... A47C 7/506 |

OTHER PUBLICATIONS

German Examination Report, dated Nov. 15, 2017, for corresponding International Application 10 2017 102 725.4 with an English translation.

* cited by examiner

HEIGHT-ADJUSTABLE FOOTREST

CROSS REFERENCE TO RELATED APPLICATIONS

This application claims priority to German Application No. 10 2017 102 725.4, filed Feb. 10, 2017, the contents of which are incorporated by reference herein.

TECHNICAL FIELD

The invention relates to a footrest for a chair, in particular, to a height-adjustable footrest, a locking means for a footrest according to the invention, as well as to a chair with the footrest according to the invention.

BACKGROUND

Chairs with footrests are known from prior art. In particular, in the school sector, chairs with footrests are popular in order to also allow for smaller pupils sitting comfortably on a chair which otherwise is too high. Further, it is known to design the footrest height adjustably such that differently large people may use one and the same chair.

With respect to chairs with height adjustable footrests, whereby the footrest is arranged between the two front chair legs, the footrest comprises two locking pins, which engage with locking holes provided in the chair legs. The locking pin, thereby, is provided with a manipulating unit respectively, by means of which the respective locking pin may be released, i.e., may be pulled out from the respective locking hole.

This, however, has the disadvantage that a simultaneous pulling out of the locking pin from the two locking holes may only be achieved with both hands.

A further disadvantage is that with a two-handed releasing of the locking pins, it is not guaranteed that the latter at the same time are released such that perhaps the side of the footrest which already has been released is displaced upwards or downwards, while the locking pin still is located on the other side in the locking hole. This may lead to damages of the locking pin, which still is located within the locking hole or of the locking hole itself.

SUMMARY

Therefore, it is an object of the present invention to provide solutions which allow for a one-handed and at the same time, safe and simple height adjustment of a footrest of a chair.

This object may be solved by means of a locking means for locking a footrest at the chair legs of a chair, a footrest for the chair, as well as a chair according to the independent claims. Preferred embodiments and further developments of the invention are specified in the respective dependent claims.

Accordingly, a locking means for locking a footrest at two chair legs of a chair is provided, wherein the locking means comprises at least a first blocking rod and a second blocking rod, and an adjustment means cooperating with the two blocking rods, Wherein the adjustment means is supported rotatably about a rotation axis, the two blocking rods are arranged coaxially to and spaced apart from each other, and perpendicular with respect to the rotation axis, respectively, the two blocking rods are coupled to the adjustment means respectively, and rotating of the adjustment means about the rotation axis causes the two blocking rods to move synchronously in opposite directions.

Thereby, it is advantageously allowed for releasing both locks at the same time, in particular, with one hand.

It is preferable, if the two blocking rods respectively comprise a rod extension at their ends facing the rotation axis, which at least in sections is guided radially outwards with respect to the respective blocking rod, wherein the sections of the rod extensions guided radially outwards extend at two opposing sides of the rotation axis, and wherein the two blocking rods are coupled to the adjustment means via the rod extensions.

Further, it has been found to be advantageous, if:

the rod extensions respectively comprise an oblong hole at the sections guided radially outwards, wherein the oblong hole runs substantially parallel to the rotation axis, and the longitudinal axis of the oblong hole is substantially perpendicular to the longitudinal axis of the blocking rods, and two pins are arranged at the adjustment means, wherein the first pin engages with the oblong hole of the first rod extension, and the second pin engages with the oblong hole of the second rod extension, wherein during rotating of the adjustment means about the rotation axis, the pins are movable within the respective oblong hole relative to the oblong hole.

The adjustment means may comprise an adjustment disc and a handle portion.

Hereby, the handle portion may be substantially perpendicular with respect to the adjustment disc.

Preferably, the two pins are arranged on the adjustment disc. The two pins may be an integral part of the adjustment disc, i.e., the pins are formed in one piece with the adjustment to disc. Alternatively, the pins may be arranged on the adjustment disk releasably.

A return means, preferably, a pressure spring, may be assigned to the two blocking rods and/or the two rod extensions. Preferably, the return means is adapted to move the blocking rods outwards away from the rotation axis.

The locking means may comprise a housing or a cover, wherein the end portions of the blocking rods facing the rotation axis are arranged within the housing or the cover, wherein the housing or the cover comprises two edge-sided openings, from which respectively one blocking rod is guided outwards.

The two edge-sided openings may be configured as guide openings being adapted to substantially prevent a rotation of the blocking rods about the rotation axis. Thus, guiding means for guiding the blocking rods arranged outside of the housing may be omitted.

A substantially cylindrically-shaped pin may be arranged within the housing or within the cover, which forms the rotation axis.

Further, a footrest for a chair is provided, wherein the latter comprises a locking means according to this disclosure and two slide elements assigned to the locking means, wherein the slide elements can be arranged at a chair leg of the chair respectively, and are displaceable along the respective chair leg.

The slide elements may comprise a guide opening or a guide channel respectively, wherein the guide opening or the guide channel runs transversely with respect to the longitudinal axis of the respective slide element, and wherein a free end of the blocking rods is respectively received in the guide opening or in the guide channel, and is guided through the guide opening or the guide channel.

The guide opening or the guide channel may be formed within the slide element such that during displacement of the slide element along the chair leg, it can be brought into a coaxial position with respect to a locking hole formed in the chair leg.

The footrest may comprise a footrest plate arranged above the locking means, wherein the slide elements respectively comprise a fixing means for fixing the footrest plate.

Further, a chair with at least two chair legs, which at least in sections run substantially straight and parallel to each other, and a locking means arranged between the two chair legs is provided, wherein the two chair legs respectively comprise at least one locking hole, with which respectively one blocking rod of the locking means can be brought into engagement.

At a top side of the locking means, a footrest plate may be attached, which is displaceable along the chair legs together with the locking means.

Eventually, a chair is provided with at least two chair legs, which at least in sections run substantially straight and parallel to each other, and with a footrest arranged between the two chair legs, wherein the two slide elements are arranged at a chair leg of the chair respectively, and are displaceable along the chair leg, and wherein the two chair legs respectively comprise at least one locking hole, with which respectively one blocking rod of the locking means can be brought into engagement.

BRIEF DESCRIPTION OF THE DRAWINGS

Further details and features of the invention can be derived from the following description in connection with the drawing.

DETAILED DESCRIPTION

Figure 1B:
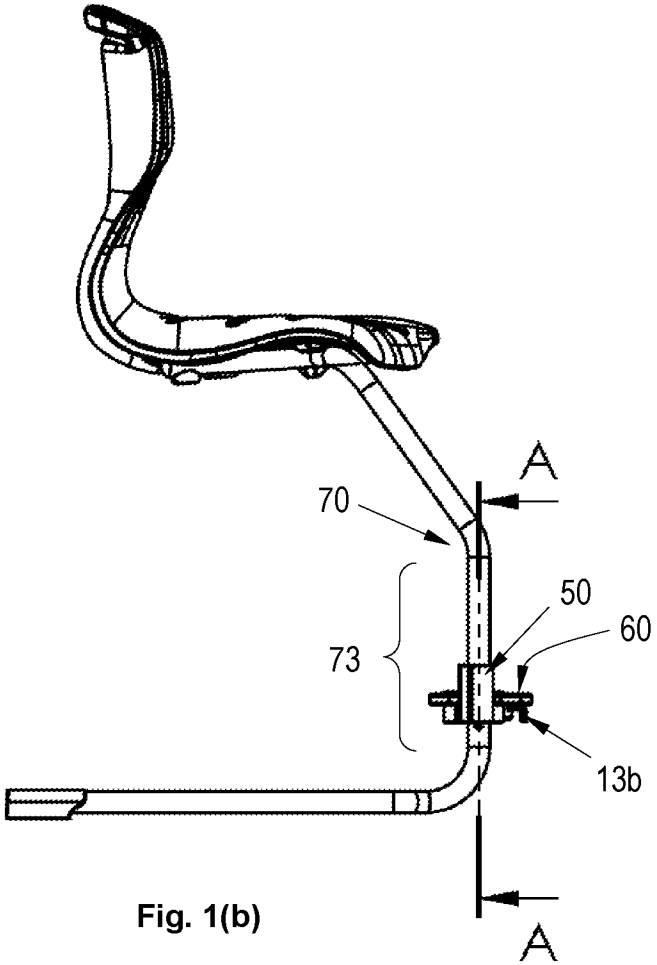
FIGS. 1(*a*)-(*b*) show a chair according to this disclosure in a perspective view and in a side view respectively.
Figure 1A:
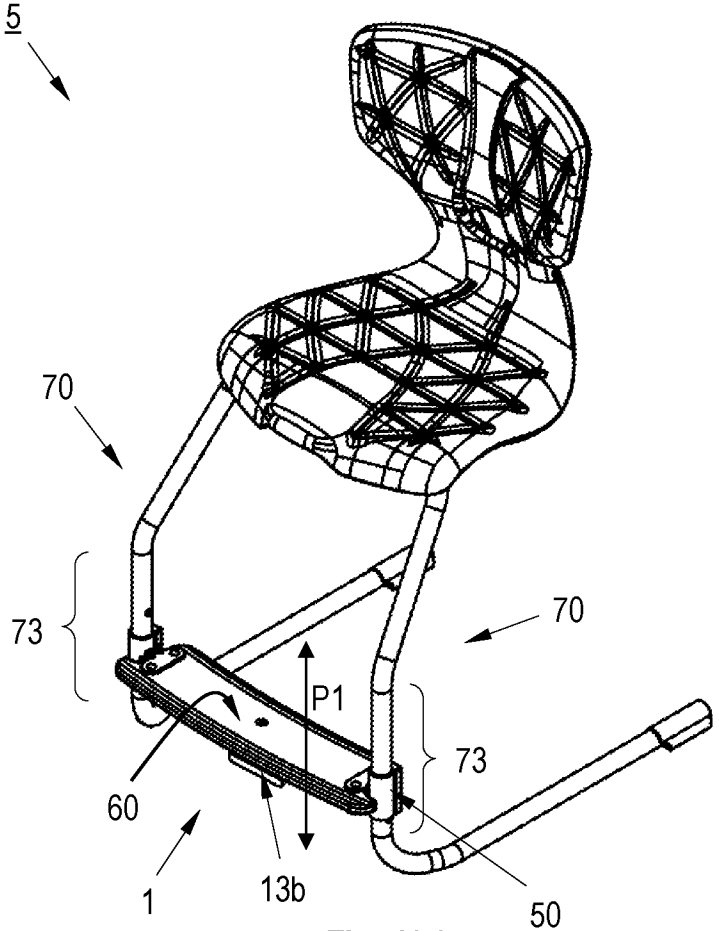

FIG. 1(*a*) shows a chair 5 in a perspective view, and FIG. 1(*b*) shows the chair shown in FIG. 1(*a*) in a side view.

Here, the chair 5 is configured as a cantilever chair. However, the disclosed locking means and footrest may also be transferred or applied to all types of chairs, which comprise at least two chair legs which at least in sections are straight and run parallel to each other.

Figure 2B:
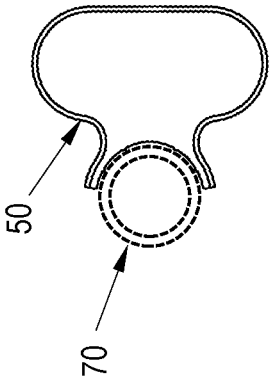
FIGS. 2(*a*)-(*b*) shows a sectional view of a lower portion of a chair leg with a footrest (left section) arranged thereon in FIG. 2(*a*) and an alternative embodiment of a slide element in FIG. 2(*b*)
Figure 2A:
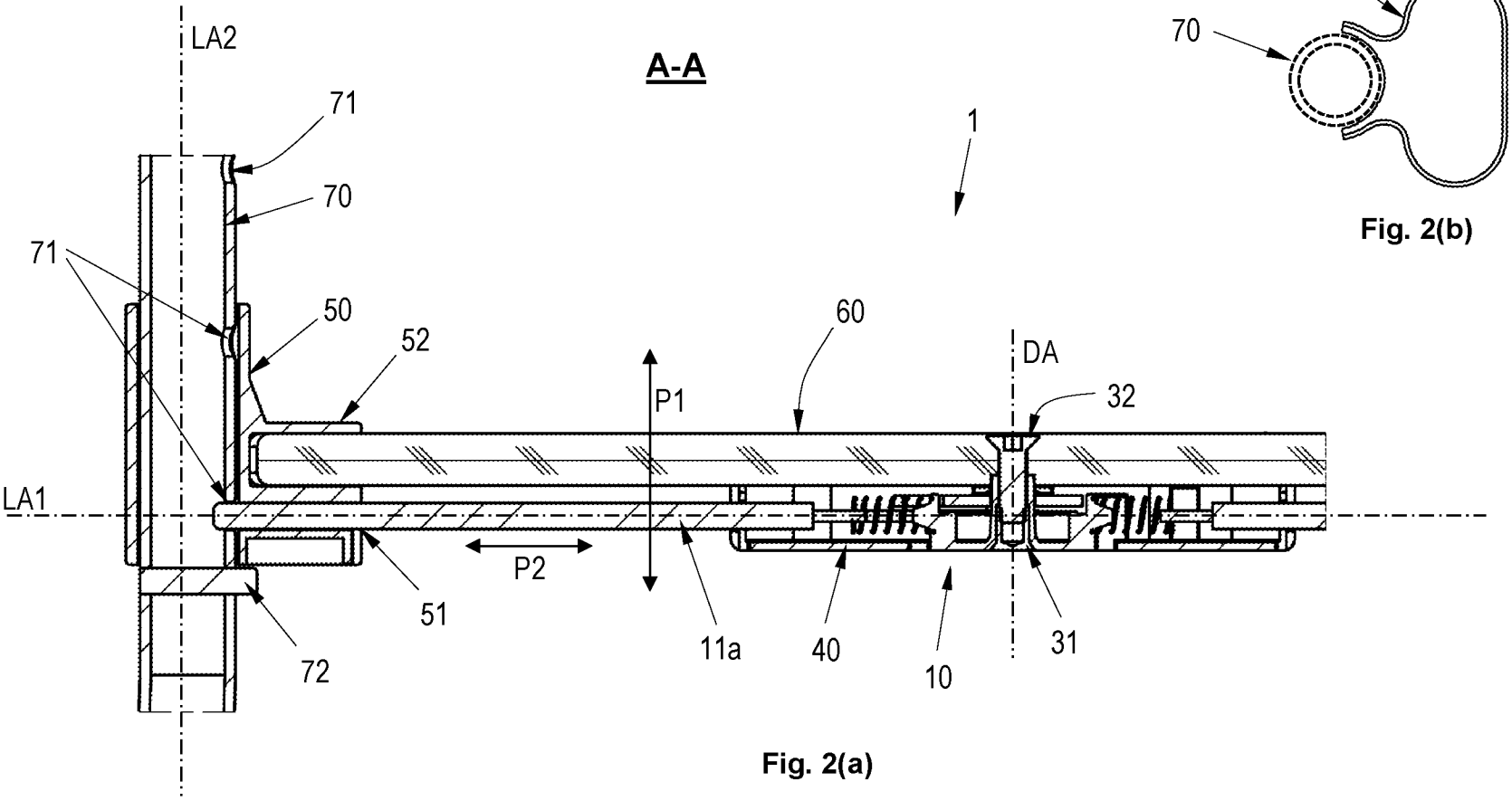

The chair 5 shown in FIGS. 2(*a*)-(*b*) has two front chair legs 70, wherein the latter respectively comprise a portion 73 being substantially straight. The two portions 73, moreover, run parallel to each other. Here, the two portions 73 run substantially perpendicular—they may also be inclined as far as they are straight and run parallel to each other.

The footrest 1 is arranged between the two portions 73 of the chair legs 70, which is height-adjustable, as indicated by the double arrow. The footrest 1 itself, here, has one slide element 50 at the two ends facing the chair legs 70 respectively, which are arranged at the chair legs 70 and which are displaceable along the chair legs, in particular, in the area of the two portions 73. Locking means (locking holes in the chair legs and locking means at the footrest) are provided on the chair legs 70 and at the footrest 1, by means of which the foot-rest 1 may be locked or fixed at certain heights. At the lower side of the footrest plate 60, there is shown a handle portion 13*b* of an adjustment means of the locking means, by means of which the locking or latching may be released in order to displace the footrest 1 upwards or downwards.

Hereby, the locking at the two chair legs 70 may be released with one hand by means of the handle portion 13*b*, and then, the footrest 1 may also be adjusted in its height with one hand. Hereby, on the one hand, it is avoided that during displacement of the footrest 1, a lock still is locked, which may lead to damages of the locking means. On the other hand, a height adjustment of the foot-rest 1 can be accomplished substantially faster and safer.

FIG. 2(*a*), shows the section A-A of a lower portion of a chair leg 70 shown in FIG. 1(*b*), with a footrest 1 arranged thereon, wherein, here, the footrest 1 is only shown in sections. The footrest 1, here, is in a locked state.

The footrest 70, here, is formed as a hollow profile—it may, however, also be formed as a solid profile. At the side facing the footrest 1, there are provided several (here: three) locking holes 71 arranged one above the other and spaced apart from each other, which here traverse the wall of the chair leg 70 completely. Instead of the locking holes 71, also blind holes may be provided, for example, in case the chair leg 70 is formed as a solid profile. The locking holes 71 or blind holes, hereby, should run perpendicular with respect to the longitudinal axes LA2 of the two chair legs.

A stop 72 or an end stop is provided at the lower end portion of the chair leg 70, which projects from the chair leg radially, and which prevents a further lowering of the footrest 1.

Figure 4B:
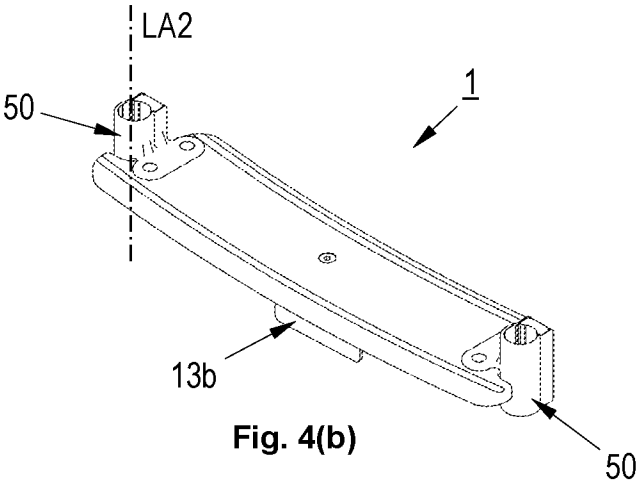
FIGS. 4(*a*)-(*b*) show a footrest according to this disclosure in an exploded view (FIG. 4(*a*)) and a perspective view (FIG. 4(*b*)).
Figure 4A:
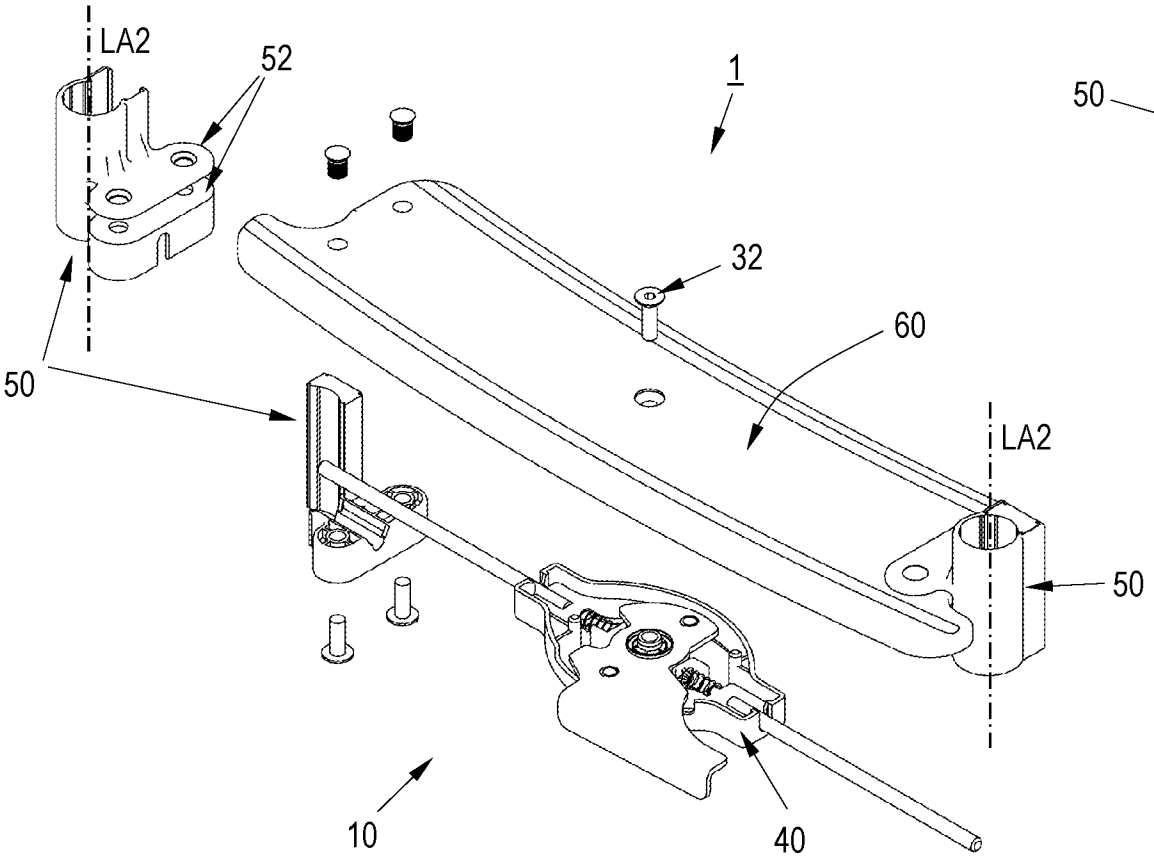

A slide element 50 is arranged at the chair leg 70, which here is configured as a guide sleeve (see also FIGS. 4(*a*)-(*b*)). The slide element 50, here, embraces the chair leg completely, and is displaceable upwards or downwards along the chair leg. According to an embodiment, the slide element 50 may also embrace the chair leg only partially, as shown in FIG. 2(*b*). In any case, the slide element 50 is to be configured such that, in a mounted state of the footrest 1 on the chair, it only is displaceable in axial direction (i.e., along the longitudinal axis LA2 of the chair pipe 70), but not in radial direction.

The slide element 50 comprises, at the side facing the footrest 1, a fixing means 52 for fixing the footrest plate 60 to the slide element 50. The fixing means 52, here, consists of two plates running radially, between which an end portion of the footrest plate 60 is brought into engagement.

Below the fixing means 52, also on the side facing the footrest 1, there is provided a guide hole 51 or a radial guide channel 51, in which a blocking rod 11*a* of the locking means 10 is received, and is insertable into the interior of the sleeve such that the end of the blocking rod projects at the inner wall of the sleeve. The guide hole 51 or the guide channel 51, preferably, is formed coaxially with respect to the blocking rod.

The slide element 50 or the guide sleeve may be formed in two parts, as shown in FIG. 4(*a*).

At the lower side of the footrest plate 60, the locking means 10 is arranged, which here is fixed from above by means of a countersunk screw to the footrest plate 60. At the side wall of the housing 40 or the cover 40, the blocking rod 11*a* is guided outwards and up to the slide member 50, where it traverses the guide channel 51 of the slide member 50 and the lowermost locking hole 71. The locking rod 11*a* is movable axially in both directions, as shown by the double arrow P2.

By operating the handle portion 13*b* of the adjustment means 13 of the locking means 10, the blocking rod 11*a* is pulled out from the locking holes 71 in order to release the locking. After the release of the locking, the slide element 50 and thereby, the complete footrest 1 may be displaced upwards or downwards.

Figures 3A, 3B, 3C:
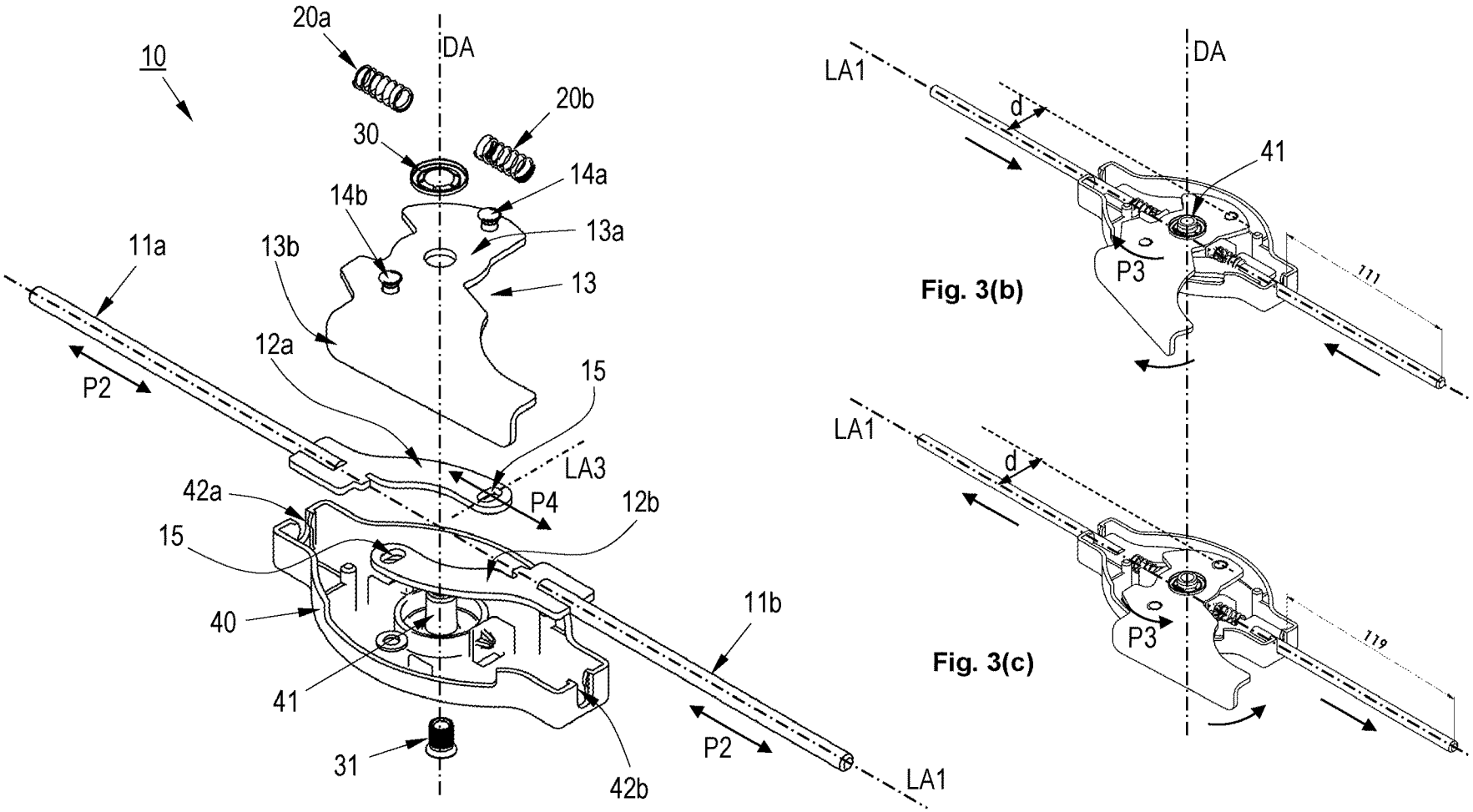
FIGS. 3(*a*)-(*c*) show a locking means according to this disclosure in an exploded view (FIG. 3(*a*)), a perspective view in a unlocked state (FIG. 3(*b*)), and a perspective view in a locked state (FIG. 3(*c*))

FIG. 3(*a*) shows a locking means 10 in an explosive view, and FIG. 3(*b*) shows a perspective view of the locking means 10 in a released state, and FIG. 3(*c*) shows a perspective view of the locking means 10 in a locked state.

The locking means 10 comprises a first blocking rod 11*a*, a second blocking rod 11*b*, and an adjustment means 13, wherein the adjustment means 13 cooperates with the two blocking rods 11*a*, 11*b*. By means of the adjustment means, the two blocking rods may be moved in axial direction (indicated by the two double arrows P2) in order to unlock the footrest 1 or in order to lock the footrest 1 at the chair legs.

The adjustment means 30 is supported rotatably about a rotation axis DA, wherein the rotation axis, here, is formed as a substantially cylindrical pin 41, which is arranged within a housing 40 or within a cover 40. Here, the adjustment means 13 itself substantially consists of an adjustment disc 13*a* and a handle portion 13*b* arranged on the adjustment disc, which here is arranged perpendicular with respect to the adjustment disc 13*a*. The handle portion 13*b* is configured such that it may be grasped easily with one hand in order to realize a one-handed release of the locking as easy as possible. Other configurations of the handle portion 13*b* are also possible.

For example, a boring is provided in the center of the adjustment disc 13*a*, through which the pin 41 (forming the rotation axis DA) is guided.

The two blocking rods 11*a*, 11*b* are coaxial and spaced apart from each other, and are arranged perpendicular with respect to the rotation axis DA respectively. Accordingly, the first blocking rod 11*a* is arranged on one side of the pin 41, and the second blocking rod 11*b* is arranged on the opposing side of the pin 41, wherein the two blocking rods respectively are substantially perpendicular with respect to the pin. The position of the two blocking rods 11*a*, 11*b* relative to the pin 41, here, is selected such that the imaginary extension of the longitudinal axis LA1 of the blocking rods run through the rotation axis DA.

According to an alternative embodiment, the imaginary extension of the longitudinal axis LA1 of the blocking rods may, however, also extend spaced apart from the rotation axis DA, in the end depending on the concrete configuration of the two rod extensions or on the arrangement of the blocking rods relative to the pin 41. Accordingly, the two blocking rods can be arranged slightly displaced in front of or rearwards of the rotation axis such that the imaginary extension of the longitudinal axis LA1 of the blocking rods extends laterally at the rotation axis DA.

The adjustment means 13 cooperates with the two blocking rods 11*a*, 11*b* such that a movement, namely, a rotation of the adjustment means 13 about the rotation axis DA results in a movement of the two blocking rods 11*a*, 11*b* in an opposite direction, wherein the two blocking rods 11*a*, 11*b* can be moved synchronously.

If the handle portion 13*b*, as shown in FIG. 3(*b*), is pivoted outwards, both blocking rods 11*a*, 11*b* are pulled axially towards the rotation axis DA, whereby the locking can be released at both chair legs simultaneously.

If the handle portion 13*b*, to the contrary, is pivoted inwards or backwards, as shown in FIG. 3(*c*), both blocking rods 11*a*, 11*b* move away from the rotation axis DA axially, whereby the footrest 1 is released simultaneously at both chair legs.

Both blocking rods 11*a*, 11*b*, here, comprise a first rod extension 12*a* and a second rod extension 12*b* at the end or end portion facing the rotation axis DA. The two rod extensions 12*a*, 12*b* at least in sections are guided radially outwards with respect to the respective blocking rod, whereby the first rod extension 12*a* of the first blocking rod 11*a* is guided outwards in the opposite direction compared to the second rod extension 12*b* of the second blocking rod 11*b*. Thereby, the two rod extensions 12*a*, 12*b* extend at least section-wise at two opposing sides of the rotation axis DA of the pin 41 such that by rotating the adjustment disc 13*a* about the rotation axis, both blocking rods are moved in opposite directions.

The two rod extensions 12*a*, 12*b*, here, are formed slightly curved. Other configurations are possible, as long as at least one section of the respective rod extension extends laterally with respect to the rotation axis.

The rod extensions may be formed in one piece with the respective blocking rod. A two-piece configuration of the blocking rod and the rod extension, however, is possible, whereby the rod extension also may be arranged at the blocking rod releasably.

The rod extensions 12*a*, 12*b*, at the sections extending laterally to the rotation axis, respectively comprise an oblong hole 15. The oblong holes 15, thus, are also arranged radially outside of the longitudinal axis LA1 of the blocking rods such that one oblong hole is located on one side of the rotation axis DA or the pin, and the other oblong hole is located on the other side of the rotation axis DA or the pin 41. The two oblong holes 15 are aligned transversely with respect to the longitudinal axis LA1 of the blocking rods, i. e., the respective longitudinal axis LA3 runs substantially transversely with respect to the longitudinal axis LA1 of the blocking rods.

Two pins 14*a*, 14*b* are provided on the adjustment disc 13*a*, which respectively are assigned to an oblong hole 15, and which engage with the respective oblong hole, and are movable within the respective oblong hole relative to the oblong hole. The adjustment disc 13*a*, thus, is coupled to the blocking rods or to the rod extensions via the two pins.

The pins 14*a*, 14*b* may be formed in one piece with the adjustment disc. Alternatively, the two pins 14*a*, 14*b* may be arranged at the adjustment disc 13*a* releasably. According to still a further alternative embodiment, through holes may be provided within the adjustment disc 13*a*, which may be guided through the pins from above downwards through the adjustment disc.

During rotation of the adjustment disc 13*a* about the rotation axis DA, also the two pins 14*a*, 14*b* rotate about the rotation axis DA, as indicated in FIGS. 3(*b*)-(*c*) by the arrows P3. At the same time, the oblong holes 15 move parallel with respect to the longitudinal axis LA1 of the blocking rods (arrow P4) and the pins 14*a*, 14*b* engaging with the oblong holes 15 move radially outwards or inwards (depending on the rotation angle) relative to the oblong holes, i.e., the horizontal distance d between the pins 14*a*, 14*b* and the longitudinal axis LA1 of the blocking rods is increased or reduced.

One return means 20*a*, 20*b* is respectively assigned to the two blocking rods 11*a*, 11*b* or the two rod extensions 12*a*, 12*b*, by means of which the two blocking rods are pushed away from the rotation axis DA or from the pin 41 in axial direction. I. e., the two blocking rods are pushed outwards by means of the return means. The return means, here, are formed as pressure springs 20*a*, 20*b*.

For releasing the footrest 1, the handle portion 13*b* is rotated outwards such that the two blocking rods 11*a*, 11*b* are moved against the spring force of the pressure springs 20*a*, 20*b* towards the pin 41. Upon releasing the handle portion, the two pressure springs cause the two blocking rods to move away from the pin 41 again such that the blocking rods are able to engage with the blocking holes 71 in the chair legs.

Optionally, the return means can be omitted. Then, the handle portion has to be rotated inwards manually in order to accomplish a locking of the footrest 1.

The inner end portions of the blocking rods, the rod extensions assigned to the inner end portions of the blocking rods, the return means, and the adjustment disc are arranged within a housing 40 or within a cover 40. A pin 41 is formed in the housing 40 or in the cover 40, which forms the rotation axis DA.

Openings are provided at two opposing side walls of the housing 40 or of the cover 40, through which the blocking rods are guided outwards. These openings, here, at the same time serve as first guide opening 42*a* for the first blocking rod 11*a*, and as second guide opening 42*b* for the second blocking rod 11*b*. Both blocking rods are guided axially by the guide openings 42*a*, 42*b*, and it is prevented that the blocking rods tilt or pivot laterally.

At the lower side of the housing 40 or the cover 40, a screw nut 31 is provided, which here is formed as a sleeve nut 31, and which cooperates with a screw guided through the locking means from the top side of the locking means 10. Advantageously, the screw is guided through a through hole provided within the pin 41. The locking means 10 may be fixed to a footrest plate 60 by means of the screw 32 and the sleeve nut 31, as shown in FIG. 2.

The adjustment means 13 is secured at the pin 41 by means of a spring washer 30.

With respect to the locking means shown in FIG. 3(*b*), the latter is in a locked state, in which the two blocking rods protrude from the housing 40 by, for example, about 111 mm.

With respect to the locking means shown in FIG. 3(*c*), the locking means is in an unlocked state, in which both blocking rods protrude from the housing 40 by, for example, about 119 mm.

The length of the two blocking rods depends on the distance of the two chair legs, between which the locking means is to be arranged.

The two blocking rods may also have a different length. Then, the locking means 10 or the handle portion 13*b* is not located centrally between the two chair legs.

FIGS. 4(*a*)-(*b*) show a footrest 1, whereby in FIG. 4(*a*), the footrest is shown in an exploded view, and in FIG. 4(*b*) the footrest is shown in a perspective view.

The two guide sleeves 50 are attached at the two end portions of the foot rest plate 60. The guide sleeves 50, here, are formed as two pieces.

The footrest plate 60 is inserted into the guide sleeves between the two fixation plates 52 and is screwed to the guide sleeves. The locking means 10 is arranged at the lower side of the footrest plate 60, and is fixed to the footrest plate by means of a screw 32 and a sleeve nut 31.

When attaching the locking means 10 to the lower side of the footrest plate 60, the housing may remain open at the top such that the housing 40 substantially forms a cover 40.

REFERENCE NUMERALS

1 footrest (locking means 10 and slide element 50)
5 chair
10 locking means
11*a* first blocking rod
11*b* second blocking rod
12*a* first rod extension of the first blocking rod 11*a*
12*b* second rod extension of the second blocking rod 11*b*
13 adjustment means
13*a* adjustments disc
13*b* handle portion
14*a* first pin at the adjustment disc 13*a*, which engages with the oblong hole 15 of the first rod extension 12*a*
14*b* second pin at the adjustment disc 13*a*, which engages with the oblong hole 15 of the second rod extension 12*b*
15 oblong hole (lined transversely with respect to the longitudinal axis LA1) within the respective rod extension 12*a*, 12*b*
20*a* first return means, e.g., pressure spring
20*b* second return means, e.g., pressure spring
30 spring washer
31 screw nut, e.g., a sleeve nut
32 screw
40 housing or cover
41 pin forming the rotation axis DA
42*a* first guide opening for the first blocking rod 11*a*
42*b* second guide opening for the second blocking rod 11*b*
50 slide element (guide sleeve) for arrangement at a chair leg 70 displaceable along the chair leg 70)
51 guide channel/guide hole in the side wall of the slide element 50, which runs transversely to the longitudinal axis LA2 of the slide element 50
52 fixing means for fixing the foot rest plate 60 to the slide element 50
60 footrest plate
70 chair leg
71 locking holds (arranged at a distance to each other vertically) in the chair leg 70
72 stop (e.g., pin projecting radially) at the chair leg 70
73 portions of the chair legs running substantially straight and parallel to each other
d horizontal distance between the pins 14*a*, 14*b* and the blocking rods 11*a*, 11*b* or the longitudinal axis LA1
DA rotation axis
LA1 longitudinal axes of the blocking rods 11*a*, 11*b*
LA2 longitudinal axis of the slide element 50 or the chair leg 70
LA3 longitudinal axis of the oblong hole 15
P1 arrow—direction of movement (linear movement) of the footrest 1
P2 arrow—direction of movement (linear movement) of the blocking rod 11*a*, 11*b*
P3 arrow—direction of movement (rotational movement) of the pin 14*a*, 14*b*

P4 arrow—direction of movement (linear movement) of the oblong holes 15

The invention claimed is:

1. A locking means (10) for locking a footrest (1) at two chair legs (70) of a chair (5), wherein the locking means comprises at least:

a first blocking rod (11*a*) and a second blocking rod (11*b*), and an adjustment means (13) cooperating with the two blocking rods (11*a*; 11*b*) wherein:

the adjustment means (13) is supported rotatably about a rotation axis (DA), the two blocking rods (11*a*; 11*b*) are arranged coaxially and spaced apart from each other and respectively perpendicular with respect to the rotation axis (DA), the two blocking rods (11*a*; 11*b*) are respectively coupled to the adjustment means (13), a rotation of the adjustment means (13) about the rotation axis (DA) causes the two blocking rods (11*a*; 11*b*) to move synchronously in opposite directions, the blocking rods (11*a*; 11*b*) respectively comprise a rod extension (12*a*; 12*b*) at their ends facing the rotation axis (DA), which at least in sections extends radially outwards with respect to the respective blocking rod, wherein the sections of the rod extensions (12*a*; 12*b*) extending radially outwards extend at two opposing sides of the rotation axis (DA), and wherein the two blocking rods (11*a*; 11*b*) are coupled to the adjustment means (13) via the rod extension (12*a*; 12*b*), the rod extensions (12*a*; 12*b*) respectively comprise an oblong hole (15) at the sections extending radially outwards, whereby the oblong hole runs substantially parallel with respect to the rotation axis (DA) and the longitudinal axis (LA3) of the oblong hole is substantially perpendicular with respect to the longitudinal axis (LA1) of the blocking rods (11*a*; 11*b*), and two pins (14*a*; 14*b*) are arranged at the adjustment means (13), wherein the first pin (14*a*) engages with the oblong hole of the first rod extension (12*a*) and the second pin (14*b*) engages with the oblong hole of the second rod extension (12*b*), whereby during rotation of the adjustment means (13) about the rotation axis (DA), the pins are movable in the respective oblong hole relative to the oblong hole.

2. The locking means of claim 1, whereby the adjustment means (13) comprises an adjustment disc (13*a*) and a handle portion (13*b*).

3. The locking means of claim 2, wherein the handle portion (13*b*) is substantially perpendicular with respect to the adjustment disc (13*a*).

4. The locking means of claim 2, wherein the two pins (14*a*; 14*b*) are arranged at the adjustment disc (13*a*).

5. The locking means of claim 1, wherein a return means (20*a*; 20*b*), preferably, a pressure spring, is associated with each of the two blocking rods (11*a*; 11*b*) respectively and/or the two rod extensions (12*a*; 12*b*) respectively, which is adapted to move the blocking rods (11*a*; 11*b*) outwards away from the rotation axis (DA).

6. The locking means of claim 1, wherein the locking means comprises a housing or a cover (40), wherein the end portions of the blocking rods (11*a*; 11*b*) facing the rotation axis (DA) are arranged within the housing or the cover, wherein the housing or the cover (40) comprises two edge-sided openings (42*a*; 42*b*), through which one blocking rod (11*a*; 11*b*) is guided outwards respectively.

7. The locking means of claim 6, wherein the two edge-sided openings (42*a*; 42*b*) are formed as guide openings, which are adapted to substantially prevent a rotation of the blocking rods (11*a*; 11*b*) about the rotation axis (DA).

8. The locking means of claim 6, wherein a substantially cylindrically-shaped pin (41) is arranged within the housing or within the cover (40), which forms the rotation axis (DA).

9. A footrest (1) for a chair (5) comprising the locking means (10) of claim 1 and two slide elements (50) associated with the locking means, wherein the slide elements can be arranged at a chair leg (70) of the chair respectively and are displaceable alongside the respective chair leg.

10. The footrest of claim 9, wherein the slide elements (50) each comprise a guide channel (51) respectively, wherein the guide channel (51) runs transversely with respect to the longitudinal axis (LA2) of the respective slide element (50), and wherein respectively one free end of the blocking rods (11*a*; 11*b*) is received within the guide channel (51), and is guided through the guide channel (51).

11. The footrest of claim 10, wherein the guide channel (51) is formed in the slide element (50) such that during displacement of the slide element along the chair leg (70), the slide element can be brought into a coaxial position with respect to a locking hole (71) formed in the chair leg.

12. The footrest of claim 9, wherein the footrest comprises a footrest plate (60) arranged above the locking means (10), and wherein the slide elements (50) comprise a fixing means (52) for fixing the footrest plate (60) respectively.

13. A chair (5) having at least two chair legs (70), which at least in sections are substantially straight and run parallel to each other, and a footrest (1) of claim 9 arranged between the two chair legs, wherein the two slide elements (50) respectively are arranged at respective chair legs of the chair, and are each displaceable along the corresponding chair leg, and wherein the two chair legs (70) comprise at least one locking hole (71) respectively, with which respectively one blocking rod (11*a*; 11*b*) of the locking means can be brought into engagement.

14. A chair (5) having at least two chair legs (70), which at least in sections run substantially straight and parallel to each other, and at least one locking means (10) of claim 1 arranged between the chair legs, wherein the two chair legs (70) comprise at least one locking hole (71) respectively, with which at least one blocking rod (11*a*; 11*b*) of the locking means can be brought into engagement.

15. The chair of claim 14, wherein a footrest plate (60) is fixed to the top side of the locking means (10), which is displaceable together with the locking means (10) along the chair legs (70).

* * * * *